United States Patent [19]

Bachot et al.

[11] Patent Number: 4,963,234

[45] Date of Patent: Oct. 16, 1990

[54] ELECTROLYTIC PRODUCTION OF QUINONE FROM HYDROQUINONE

[75] Inventors: Jean Bachot, Bourg la Reine; Le Roux, Olivier, Paris, both of France

[73] Assignee: Rhone-Poulenc Chimie, Courbevoie, France

[21] Appl. No.: 421,833

[22] Filed: Oct. 16, 1989

[51] Int. Cl.[5] ..... C25B 3/02

[52] U.S. Cl. ..... 204/78

[58] Field of Search ..... 204/78

[56] References Cited

U.S. PATENT DOCUMENTS 3,897,319 7/1975 Anderson et al. ..... 204/78

OTHER PUBLICATIONS

Patent Abstracts of Japan, vol. 6, No. 231 (C-135), Nov. 17, 1982, & JP-A-57 134 581 (Shigeru Torii), 19-0-8-1982.

Patent Abstracts of Japan, vol. 7, No. 46 (C-153), Feb. 23, 1986, & JP-A-57 198 283, Asahi Glass K.K.), 04-1-2-1982.

*Primary Examiner*—John F. Niebling

*Assistant Examiner*—Steven P. Marquis

*Attorney, Agent, or Firm*—Burns, Doane, Swecker & Mathis

[57] ABSTRACT

Quinones are produced by electrolysis of corresponding hydroquinones, in the anode compartment of an electrolytic cell, by electrolyzing a dispersion or emulsion including a conductive aqueous solution of hydroquinone and at least one stable cosolvent which is poorly soluble in water but which is a good solvent for the quinone produced and a poor solvent for the hydroquinone.

7 Claims, No Drawings

ELECTROLYTIC PRODUCTION OF QUINONE FROM HYDROQUINONE

BACKGROUND OF THE INVENTION

1. Field of the Invention

The present invention relates to the preparation of quinone, and, more especially, to the electrolytic preparation of quinone from hydroquinone.

2. Description of the Prior Art

It is known to this art that quinones can be prepared by electrolysis of an aqueous solution of a corresponding hydroquinone. However, and this is especially the case as regards the electrolysis of an aqueous solution of hydroquinone, the yield of such reaction is very low because of the precipitation of a compound resulting from the addition of one molecule of hydroquinone to one molecule of quinone, such a compound being designated a quinhydrone.

Attempts have been made to reduce the risk of formation of this addition compound (quinhydrone) by conducting the reaction either in very dilute solutions, resulting in very low Faraday efficiency, or at high temperature, but in this case there is a risk of degradation of the final product quinone.

SUMMARY OF THE INVENTION

Accordingly, a major object of the present invention is the provision of an improved process for the preparation of quinone on an industrial scale, by electrolysis of an aqueous medium containing a hydroquinone.

Briefly, the present invention features electrolysis of an aqueous dispersion or emulsion of hydroquinone, such reaction medium further comprising a stable cosolvent which is poorly soluble in water, but which is a good solvent for quinone and a poor solvent for hydroquinone.

DETAILED DESCRIPTION OF THE PREFERRED EMBODIMENTS OF THE INVENTION

More particularly according to the present invention, the required cosolvent must have the following properties:

(a) the cosolvent must be stable, i.e., it must exhibit chemical stability vis-a-vis all materials present and electrochemical stability under the operating conditions employed. This stability of the cosolvent is important insofar as any instability of such material will be reflected in the appearance of impurities (which will have to be later removed) and in a decrease in process efficiency;

(b) the cosolvent must be poorly soluble in water and vice versa; indeed, the cosolvent is employed to constitute a phase which is independent of the aqueous phase and the solubility of such cosolvent in water must therefore be as low as possible. This low solubility of the cosolvent in water implies that the electrolysis will be carried out in a medium comprising two phases (emulsion);

(c) the cosolvent must be a poor solvent for hydroquinone and a good solvent for quinone. In fact, one of the functions of this cosolvent during the electrolysis is to ensure separation of the hydroquinone from quinone, thus avoiding formation of an addition product of the quinhydrone type.

In addition to these properties, which are essential for a proper carrying out of the process according to the invention, the cosolvent must permit an easy recovery of the quinone produced. Although cosolvents of a relatively high boiling point can be advantageous, because it will thus be possible to conduct the electrolysis at elevated temperatures, it is generally desirable to select a cosolvent having a relatively low boiling point, because this will enable the subsequent recovery of the quinone by simple cosolvent evaporation to be facilitated.

Exemplary of the cosolvents possessing such properties, particularly representative are aromatic hydrocarbons (especially toluene and benzene), cycloalkanes, alkanes and halogenated aliphatic hydrocarbons (such as methylene chloride and 1,2-dichloroethane). The halogenated aliphatic hydrocarbons are the more preferred solvents.

The solubilities of para-benzoquinone in various solvents are given below, by way of examples:

Toluene solubility approximately 70 g/l

Benzene solubility approximately 40 g/l

Dichloromethane solubility approximately 36 g/l 1,2-Dichloroethane solubility approximately 50 g/l whereas hydroquinone is soluble only to a minor extent in such solvents. It is of course possible to use mixtures of these cosolvents.

In the process according to the invention, the relative amounts of water and of cosolvent may vary depending on the nature of the cosolvent and optionally with the reactants (hydroquinone and quinone). For given reactants (for example the electrolysis of hydroquinone to produce p-benzoquinone), it will be appropriate to adjust these relative amounts to take into account, on the one hand, the conductivity of the emulsion (which would require a high proportion of aqueous phase) and, on the other hand, of the amount of p-benzoquinone to be extracted (which would require a high proportion of organic phase). In practice, the volume ratio of the aqueous and organic phases typically ranges from 0.1 to 50 and preferably from 0.5 to 10. When such ratio is lower than 0.1, with the aqueous phase being in a very low proportion, the conductivity of the mixture is poor. When such ratio is higher than 50, the quinone is insufficiently dissolved.

It will also be appreciated that the "quality" (that is to say, the fineness and the stability) of the dispersion of the cosolvent in the aqueous phase can have an effect on the reaction yield. In consideration of the methods of preparation employed to produce the dispersion or the emulsion (for example with the aid of a pump or of a static mixer), one skilled in this art can easily conduct such operation, for example by adding emulsifying or surfaceactive agents thereto, to attain a maximum yield.

The temperature at which the electrolysis is carried out, has a known influence (an increase in the temperature improving the conductivity of the emulsion, improving the solubility of the reactants in their media and improving the reaction kinetics); however, if a cosolvent of a relatively low boiling point is employed because of quinone recovery problems, the boiling point of this cosolvent will be a limiting factor In practice, temperatures ranging from 10° to 80° C. will be employed.

The concentration of hydroquinone in water does not appear to be a critical factor with regard to the degree of conversion of hydroquinine to quinone at equal electrical efficiency, but any increase in such concentration (within the solubility limits of hydroquinone) will promote the volume efficiency.

With regard to the electrical current density, this is generally on the order of 5 to 40 A/dm$^2$.

The reaction is carried out in a traditional electrolysis cell, preferably including a separator. When such a cell comprises a separator, the latter is preferably of the cationic type such as, for example, a Nafion membrane. In the cathode compartment is carried out, as is known, the reduction of a water which has been rendered conductive using an acid such as sulfuric acid, as well as other electrochemical reduction reaction in this cathode compartment; the cathode must be noncorrodible and with an overvoltage which is as low as possible. Into the anode compartment is introduced the dispersion or the emulsion according to the invention, thus comprising an aqueous phase whose conductivity has been improved by virtue of the addition of an acid which is inert towards the reactants (such as sulfuric acid, phosphoric acid or nitric acid) and/or of a salt and an organic phase dispersed or emulsified in the said aqueous phase. The anode is fabricated from a stable (that is to say, noncorrodible) material, which is advantageously a lead oxide or alloy or, preferably, a metal such as, for example, titanium, the surface of which is coated with metals or metal oxides, at least one of which belongs to the platinum group. The structure of the anode can be very varied; expanded or perforated or solid anodes will advantageously be employed It is obviously possible to carry out the process noncontinuously or continuously, the latter mode of operation being preferred. To optimize efficiencies, it is also possible to use a number of reactors mounted in series, in each of which the operating conditions can be adapted to the mixtures to be processed.

The hydroquinones which can be employed according to the invention may be defined as all those which form a quinhydrone in aqueous media in the presence of a corresponding quinone.

The particular typical case is that where parabenzoquinone is prepared from hydroquinone. It is essentially this particular case which will be illustrated hereinafter.

In order to further illustrate the present invention and the advantages thereof, the following specific examples are given, it being understood that same are intended only as illustrative and in nowise limitative.

Examples 1 to 16 Were carried out noncontinuously, namely, by conducting the electrolysis of a certain volume of dispersion (or emulsion), this dispersion being either contained in the suitably stirred anode compartment of the electrolyzer or circulated in a loop closed onto the said anode compartment. Example 17 was carried out continuously.

EXAMPLES 1 To 13

In all of the examples, a cell was used comprising a Nafion 423 separation membrane, a catholyte comprising an 0.5 N aqueous solution of $H_2SO_4$, an Incoloy 825 cathode and an anode which was either coated titanium or lead; an amount of cosolvent was always employed in the anolyte, such that the volume ratio of the organic phase to the aqueous phase was 0.5, the said aqueous phase being 0.1N sulfuric acid.

In all tests it was found that the chemical efficiency, namely, the percentage of hydroquinone converted into quinone (in moles) was very high, from 91 to 100%. The Faraday efficiency, which was very high (80 to 100%) at the beginning of the reaction, decreases with time because of the decrease in the concentration of hydroquinone and prevented the development of interfering reactions (water oxidation).

Strictly logically, therefore, it would be appropriate to consider the reaction efficiencies at each instant of this reaction period. Such a study, even though it is of interest for optimizing the reaction from an industrial standpoint, is not complete at present; the results provided will therefore be confined to the overall yields upon completion of reaction, the said reaction having been terminated after only approximately 70 to 95% of the initial hydroquinone had been consumed, namely, after reaction periods on the order of 50 to 80 minutes.

The results obtained for the conversion of hydroquinone to para-benzoquinone are reported in Table I. Example 1 was carried out using a titanium anode coated with platinum of solid shape: Examples 2 to 7 were carried out using an anode fabricated from platinum-coated expanded titanium; Examples 8 to 11 were carried out using a perforated titanium anode on which iridium, cobalt and tantalum oxides were deposited simultaneously; Example 12 was carried out using a perforated lead electrode; Example 13 was carried out using a perforated anode made of palladized titanium coated with platinum-iridium.

In Examples 2, 3, 5, 6 and 7, the voltage $\Delta V$ varied during the test from approximately 6 to approximately 8V; this voltage remained constant and equal to 4.5V in Example 4, at 4.25V in Example 8, at 5V in Example 9, at 2.8 V in Examples 10 and 11, at 4.9V in Example 12 and at 3.2V in Example 13.

EXAMPLE 14

The procedure of Example 2 was repeated, using toluhydroquinone in a concentration of 10 g/l instead of hydroquinone. The corresponding toluquinone was obtained with a Faraday efficiency of 84% and a chemical yield of 88%.

EXAMPLE 15

In this example, a palladized titanium anode coated with platinum and iridium and an anolyte whose aqueous phase had an acidity of 0.4N as $H_2SO_4$ were employed.

The other experimental conditions were the following:

Current density:20 A/dm$^2$
Temperature:35° C.
Hydroquinone concentration:20 g/l
Cosolvent:$CH_2Cl_2$
$\Delta V$:3.25V.

The Faraday efficiency was 85%.

EXAMPLE 16

In this example, a titanium anode coated with platinum and an anolyte whose aqueous phase having an acidity of 0.1 N as sulfuric acid were used.

The other experimental conditions were the following:

Current density:10 A/dm$^2$
Temperature:20–25° C.
Hydroquinone concentration:30 g/l
Cosolvent:$CH_2Cl_2$
$\Delta V$: 15V Volume ratio of the organic phase to the aqueous phase 1.2.

The Faraday efficiency of the reaction was 68.5% and the chemical yield 100%.

EXAMPLE 17

This example was performed "continuously".

The apparatus comprised an electrolyzer with two compartments separated by a separator of a cationic type (Nafion trademark membrane).

An 0.5N aqueous solution of sulfuric acid was circulated through the cathode compartment.

A mixture of 0.1N sulfuric acid, of dichloromethane (ratio of the organic phase to the aqueous phase of 0.5) and of hydroquinone (hydroquinone concentration 20 g/l) was charged into the anode compartment. On exiting this compartment, the mixture was separated into phases, the organic phase was removed in order to recover the quinone produced therefrom, and the organic phase was recycled (topped by adding water and hydroquinone dichloromethane).

The anode was fabricated from titanium coated with platinum and iridium.

The temperature was 35° C., the current density 10 $A/dm^2$ and the potential difference 4.25V.

A Faraday efficiency of 100% and a degree of conversion of 78% were obtained.

TABLE

| EXAMPLE NO. | Current density $A/dm^2$ | Temperature (°C.) | Hydroquinone concentration g/l (aqueous phase) | Cosolvent | Faraday efficiency % | Chemical yield % | Remarks |
|---|---|---|---|---|---|---|---|
| 1 | 10 | 20–60 | 20 | Toluene | 62 | 98 | |
| 2 | 20 | 35 | 20 | $CH_2Cl_2$ | 79 | 100 | |
| 3 | 20 | 25 | 30 | $CH_2Cl_2$ | 81.5 | 95.5 | |
| 4 | 10 | 35 | 20 | $CH_2Cl_2$ | 51.5 | 92.5 | without separator |
| 5 | 20 | 35 | 20 | $C_2H_4Cl_2$ | 80 | 91 | |
| 6 | 20 | 50 | 20 | $C_2H_4Cl_2$ | 84 | 90.5 | |
| 7 | 20 | 50 | 30 | $C_2H_4Cl_2$ | 87 | 98.5 | |
| 8 | 20 | 35 | 20 | $CH_2Cl_2$ | 73.5 | 99.5 | |
| 9 | 20 | 35 | 20 | $CH_2Cl_2$ | 68 | — | $\Delta V = 5$ V; Circulation velocity 0.7 m/s |
| 10 | 20 | 35 | 20 | $CH_2Cl_2$ | 85.5 | — | $\Delta V = 2.8$ V; Circulation velocity 1.1 m/s |
| 11 | 20 | 35 | 20 | $CH_2Cl_2$ | 91.5 | 96 | $\Delta V = 2.8$ V; Circulation velocity 1.5 m/s |
| 12 | 20 | 35 | 20 | $CH_2Cl_2$ | 87.5 | — | |
| 13 | 20 | 35 | 20 | $CHCl_3$ | 85 | — | |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the preparation of a quinone, comprising electrolyzing, in the anode compartment of an electrolytic cell, a dispersion or emulsion which comprises a conductive aqueous solution of a corresponding hydroquinone and at least one stable cosolvent which is poorly soluble in water but a good solvent for the final quinone product and a poor solvent for the starting material hydroquinone.

2. The process as defined by claim 1 comprising the preparation of para-benzoquinone.

3. The process as defined by claim 1, said cosolvent comprising an aromatic hydrocarbon, cycloalkane, alkane or halogenated aliphatic hydrocarbon, or admixture thereof.

4. The process as defined by claim 1 said electrolytic cell comprising a cationic separator.

5. The process as defined by claim 1, said electrolytic cell comprising a coated metal anode.

6. The process as defined by claim 5, said anode comprising titanium coated with a platinum group metal.

7. The process as defined by claim 1, said dispersion or emulsion comprising an acidified aqueous solution of the hydroquinone.

* * * * *